US005436447A

United States Patent [19]

Shew

[11] Patent Number: 5,436,447

[45] Date of Patent: Jul. 25, 1995

[54] METHOD AND APPARATUS FOR DETERMINING RELATIVE ION ABUNDANCES IN MASS SPECTROMETRY UTILIZING WAVELET TRANSFORMS

[75] Inventor: Sanford L. Shew, Madison, Wis.

[73] Assignee: Waters Investments Limited, Wilmington, Del.

[21] Appl. No.: 282,037

[22] Filed: Jul. 28, 1994

[51] Int. Cl.[6] ..... H01J 49/26

[52] U.S. Cl. ..... 250/291; 250/282

[58] Field of Search ..... 250/282, 291, 286, 281, 250/283, 290

[56] References Cited

U.S. PATENT DOCUMENTS

| | | | |
|---|---|---|---|
| 3,937,955 | 2/1976 | Comisarow et al. . | |
| 4,761,545 | 9/1988 | Marshall et al. . | |
| 4,931,640 | 6/1990 | Marshall et al. | 250/291 |
| 4,945,234 | 7/1990 | Goodman et al. . | |
| 5,013,912 | 5/1991 | Guan et al. | 250/291 |
| 5,047,636 | 9/1991 | Farrar et al. . | |
| 5,248,882 | 9/1993 | Liang . | |

OTHER PUBLICATIONS

Koning et al., "Segmented Fourier Transform", International Journal of Mass Spectrometry and Ion Processes, vol. 95, 1989, pp. 71–92.

J. F. Loo, et al., "Accurate Ion Abundance Measurements in Ion Cyclotron Resonance Mass Spectrometry by Linear Prediction," Rapid Communications in Mass Spectrometry, vol. 4, No. 8, 1990, pp. 297–299.

Thomas J. Farrar, et al., "Application of Linear Prediction to Fourier Transform Ion Cyclotron Resonance Signals for Accurate Relative Ion Abundance Measurements," Analytical Chemistry, vol. 64, 1992, pp. 2770–2774.

I. Daubechies, *Ten Lectures on Wavelets* (book), CBMS/NSF Series in Applied Mathematics, vol. 61, Society for Industrial and Applied Mathematics, Philadelphia, Pa., 1992, Chapter 1, "The What, Why, and How of Wavelets", pp. 1–16.

Sanford L. Shew, "Wavelet Transforms in Fourier Transform Mass Spectrometry," Abstract from 1993 Pittsburg Conference Abstract Book, Mar. 1993.

Sanford L. Shew, "Data File Compression with Wavelet Transforms," ICR/Ion Trap Newsletter, spring 1993, No. 30, pp. 32–34.

*Primary Examiner*—Jack I. Berman
*Assistant Examiner*—James Beyer
*Attorney, Agent, or Firm*—Foley & Lardner

[57] ABSTRACT

Relative ion abundances in ion cyclotron resonance mass spectrometry are determined utilizing wavelet transforms to isolate the intensity of a particular ion frequency as a function of position or time within the transient ion cyclotron resonance signal. The wavelet transform intensity corresponding to the frequency of each ion species as a function of time can be determined, an exponential decay curve fitted to such data, and the decay curves extrapolated back in time to the end of the excitation phase to determine accurate values for the relative abundances of the various ions in a sample. By determining the abundances of ions at a point in time at or near the end of excitation, the effects of different rates of decay of the intensity of the signal from different ions species can be reduced, and more accurate ion abundance measurements obtained.

22 Claims, 14 Drawing Sheets $\log [WT] = 11.67 - 0.0002447t_n$ $\log [WT] = 10.57 - 0.0004886t_n$ $$\text{Log [WT]} = 11.66 - 0.0002403t_n$$

METHOD AND APPARATUS FOR DETERMINING RELATIVE ION ABUNDANCES IN MASS SPECTROMETRY UTILIZING WAVELET TRANSFORMS

FIELD OF THE INVENTION

This invention pertains generally to the field of ion mass spectrometry and the quantitative analysis of ion abundances in such spectrometry.

BACKGROUND OF THE INVENTION

An ion cyclotron uses a magnetic field to deflect an ion moving at some velocity through the field. For a spatially uniform magnetic field having a flux density B, a moving ion of mass m and charge q will be bent into a circular path in a plane perpendicular to the magnetic field at an angular frequency $\omega_0$ in accordance with $\omega_0=qB/m$. Thus, if the magnetic field strength is known, by measuring the ion cyclotron frequency, it is possible in principal to determine the ionic mass-to-charge ratio m/q. In effect, the static magnetic field converts ionic mass into a frequency analog. Because the cyclotron frequencies for singly charged ions ($12 \leqq m/q$ 5000) in a magnetic field of about 3 Tesla span a radio frequency range (10 KHz $\leqq f \leqq$ 4 MHz) within which frequency can be measured with high precision, the ion cyclotron is potentially capable of offering extremely high mass resolution and accuracy.

Fourier transform techniques have been utilized in the detection scheme of ion resonance in mass spectrometry. In such techniques, the whole spectrum of ions is excited at once and the whole spectrum is thereafter detected at once. Such Fourier transform ion cyclotron resonance spectroscopy techniques are described further in U.S. Pat. No. 3,937,955 to Comisarow, et al., the disclosure of which is incorporated herein by reference. Fourier transform mass spectrometry excitation and detection techniques are also discussed in the patents to Marshall, et al., U.S. Pat. No. 4,761,545, Goodman, et al., U.S. Pat. No. 4,945,234 and Liang, U.S. Pat. No. 5,248,882.

Fourier transform mass spectrometry has become a powerful analytical tool because of several important advantages as compared with other types of mass spectrometry (MS). For example, Fourier transform MS offers both high resolving power and high mass accuracy. Additionally, because the ions are confined to a cell, multiple MS experiments (MS/MS, MS/MS/MS, etc.) are easy to perform. Chemical reactions involving trapped ions and neutrals can also be studied. Because the reaction times can be varied easily, kinetic and thermodynamic properties can be measured. For these experiments and many others, it is desirable to be able to determine the relative ion abundances accurately.

In any Fourier transform MS experiment, ions are ultimately detected following excitation of ions to a sufficient orbital radius. When the excitation pulse is turned off, the ions continue to orbit at the respective ion frequencies. After a short delay time, the signal induced in detection plates is measured. The intensity of the induced signal is proportional to the number of ions orbiting in the cell, so it can be expected that one could quantitate ion abundance by correlation with the signal intensity. However, during the delay between excitation and detection, the ions undergo collisions with neutral species in the cell. These collisions cause the orbiting ions to lose energy, resulting in a gradual decrease in the orbital radius. Because the induced signal on the detection plates is greater the closer the ions approach the detection plates, this decaying radius results in a gradual decrease in signal intensity. A stylized sequence for an MS experiment to illustrate this process is shown in FIG. 1, illustrating the relative timing of the ionization phase, the excitation phase, and the detection phase, with an idealized observed signal shown schematically in FIG. 2. The idealized time domain signal in FIG. 2, representing the signal on the detection plates corresponding to a well defined ion (or group of ions) orbiting at a constant frequency, is seen to have a magnitude envelope that declines exponentially after the cessation of the excitation phase at $t_o$ (at time=0.000 in FIG. 2).

The signal decay, as illustrated in FIG. 2, has a detrimental effect on the reliability of quantitation of ion species in Fourier transform MS. One way to address this problem is to minimize the number of collisions that orbiting ions are subjected to. This can be accomplished by lowering the pressure in the cell, although for some experiments, high pressures are necessary, as in MS/MS. One means of achieving low pressures during the detection phase, even when higher pressures are required or unavoidable during some part of the experiment, is the use of a differentially pumped dual cell.

In addition to the effect on absolute ion abundance measurements, the decay rates of the signals from different ions can be different, which affects the relative ion abundance measurements. It is desirable to be able to correct for these differential decay rates to obtain accurate relative ion abundance measurements.

One relatively straight-forward way to obtain this correction is by utilizing segmented Fourier transforms. See, e.g., L. J. de Konig, et al., Int. J. Mass Spectrom. Ion Processes, Vol. 95, 1989, pp. 71–92. In such a technique, a transient signal is divided into a number of smaller contiguous segments, and normal Fourier transform processing is performed on the segments. For example, if a transient contains 65,536 (64 K) points, it could be divided into eight segments, each containing 8,192 (8 K) points. Then, the peak heights of the ions in the mass spectra can be plotted as a function of segment, or equivalently, as a function of time (to the resolution of the time period of each segment) within the transient. It is found with such techniques that the signal from each ion species decays exponentially, so that an exponential decay curve can be fitted to the measured signal resulting from any given measured ion. Then, with the fitted parameters for the exponential decay known, and with knowledge of when the excitation phase ended relative to the beginning of detection of the signal, it is possible to extrapolate back in time, using the fitted exponential decay parameters, and thus estimate the abundance of each ion at the time of the end of excitation. The accuracy of such a technique is limited, in part, by the fact that only a limited number of segments are analyzed.

Another approach is described in the United States patent to Farrar, et al., U.S. Pat. No. 5,047,636. In this approach, the digital samples of the time domain signal are transformed into frequency domain data by linear prediction using a linear least-squares procedure. The resulting frequency domain data is then used to determine the mass of the different types of ions present and the relative number of each type of ion.

SUMMARY OF THE INVENTION

In accordance with the present invention, relative ion abundances are determined accurately in mass spectrometry processes by analysis of the damped detected MS signal transients. The present invention utilizes wavelet transforms to isolate the intensity of a particular frequency as a function of position or time within the transient signal. This isolation results from the time-frequency localization provided by the wavelet transform. The wavelet transform intensity corresponding to each frequency as a function of time (corresponding to a single ion species) can be determined, an exponential decay curve can be fitted to such data, and those decay curves can be extrapolated back in time to the end of the excitation phase to determine accurate values for the relative abundances of various ions.

In the present invention, mass spectrometry apparatus having an evacuated cell with excitation and detection plates is in the field of a strong magnet. The ions to be detected are formed by ionization in any desired manner, the ions are then excited by application of excitation signals to the excitation plates, and, at an appropriate time after excitation has ceased, the signal from the orbiting ions is detected. A Fourier transform mass spectrometry procedure may then be utilized to determine the ion frequencies (determined by the mass to charge ratios of the ionic species). With such ion frequencies known, and with a mother wavelet function selected, a wavelet function is determined for each species, based on the mother wavelet, which has parameters selected to match the frequency of that species. A wavelet transform is then performed utilizing the wavelet functions determined for each ion frequency to obtain wavelet transforms as a function of time for each ion frequency. Exponential decay curves are then fitted to the decaying wavelet transform data, and an extrapolation is made of the fitted curve back in time, e.g., from the start of detection to the end of excitation. The magnitudes of the fitted curves for each of the ionic species at the end of excitation provides the relative abundance of that species with respect to the other species. Generally, it is preferred to determine the relative abundance of the ion species at the time of the end of excitation, rather than at other times after excitation and before or during detection, since the rate of decay for each of the ion species may, and generally does, differ.

Further objects, features and advantages of the invention will be apparent from the following detailed description when taken in conjunction with the accompanying drawings.

DETAILED DESCRIPTION OF THE INVENTION

Figure 3:
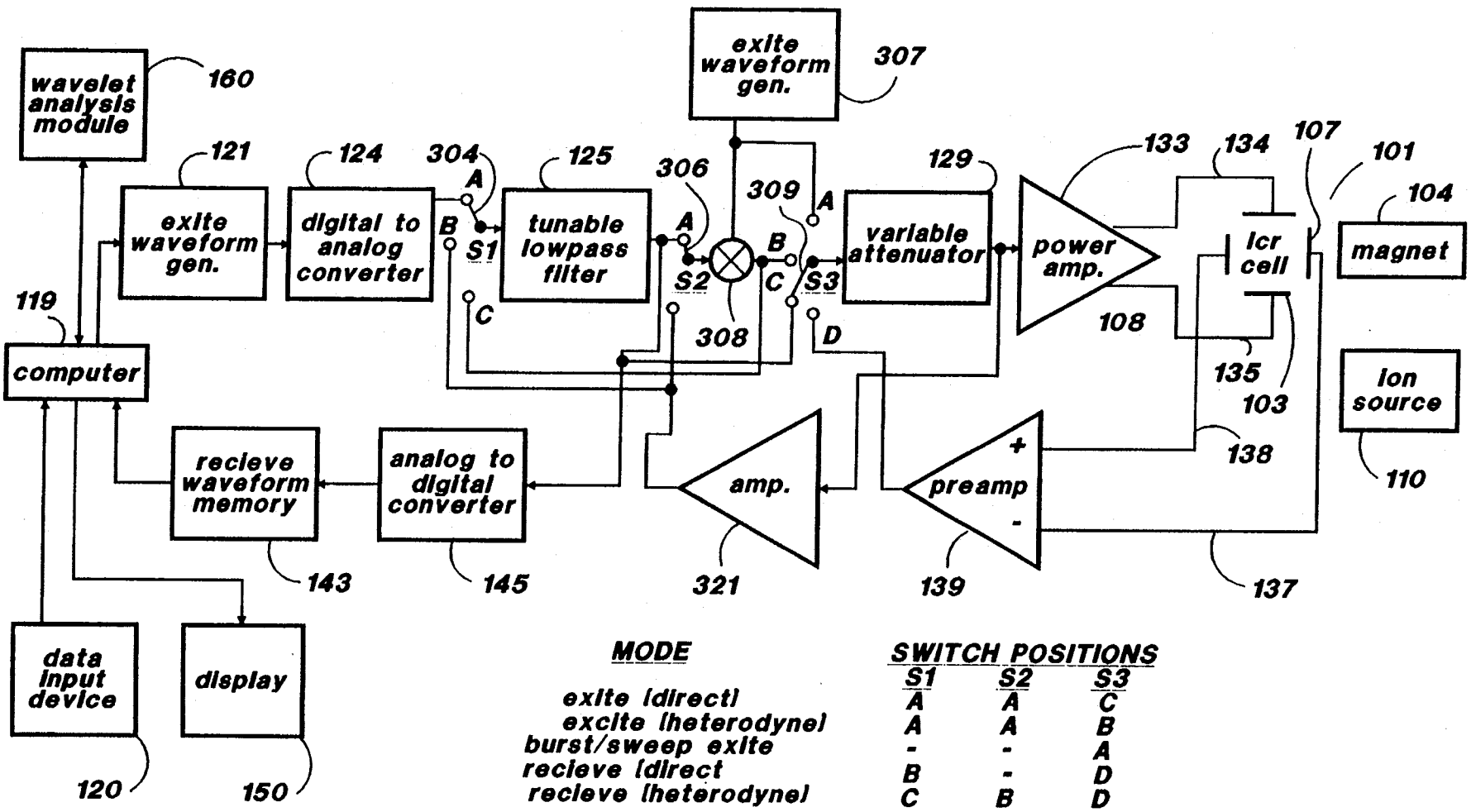
FIG. 3 is a block diagram of an ion cyclotron resonance mass spectrometer system which incorporates the present invention.

The present invention can be utilized with standard ion cyclotron resonance mass spectrometers, which typically use Fourier transform processing to determine the ion species in the cell. The invention may be embodied in various types of mass spectrometry apparatus. For exemplification, a schematic block diagram of an ion cyclotron resonance mass spectrometer system which can incorporate the present invention is shown in FIG. 3. The system includes an ion cyclotron resonance (ICR) trap or cell 101. As used herein, the term ion trap includes an ICR cell as well as other types of ion traps. The structure of such cells is well known in the art, and in general such cells are enclosed in an evacuable chamber with a vacuum pump and other ancillary equipment utilized to achieve the desired low pressure in the cell. A magnet 104, typically a superconducting solenoid, produces the magnetic field inside the ICR cell and is well known and shown only schematically in FIG. 1. For purposes of illustration, the ICR trap cell 101 is shown as having a substantially rectangular cross-section with top and bottom plates 102 and 103, serving as excitation electrodes, and opposed side plates 107 and 108 which may serve as detector electrodes. End trapping plates conventionally used in ICR cells are not shown in FIG. 1. A variety of geometric configurations for ICR cells are well known. The magnet typically produces a substantially constant unidirectional magnetic field through the ICR cell such that the electric field from potentials applied to the excitation electrodes is transverse to the applied magnetic field. Various ion source means 110 for introducing ions in the cell 101 are well known and may be used, including sources which generate ions in the cell or sources which generate ions outside the cell with subsequent transport into the cell.

Figure 1:
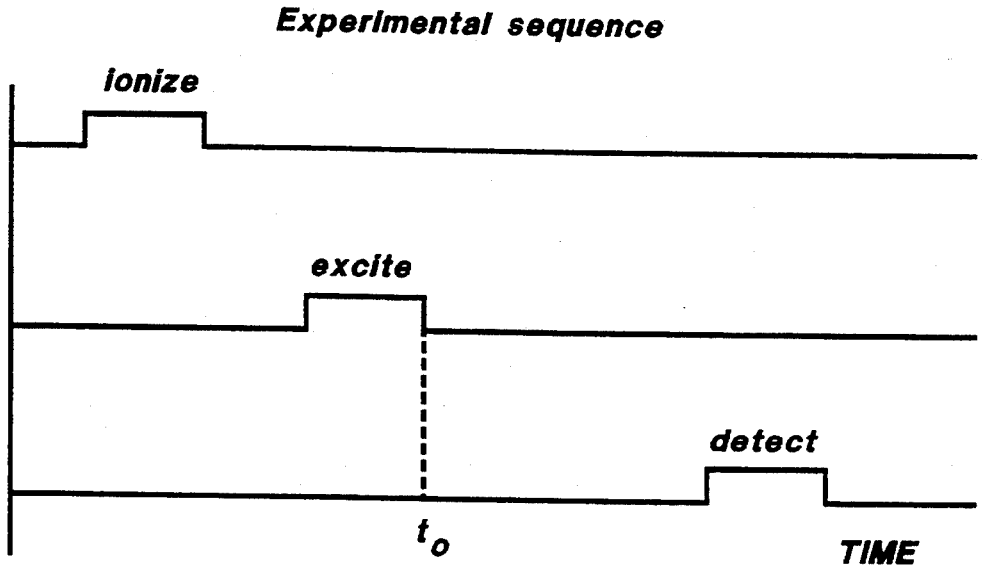
FIG. 1 are simplified graphs showing the relative position of the ionization phase, excitation phase and detection phase in a Fourier transform MS experiment.
Figure 2:
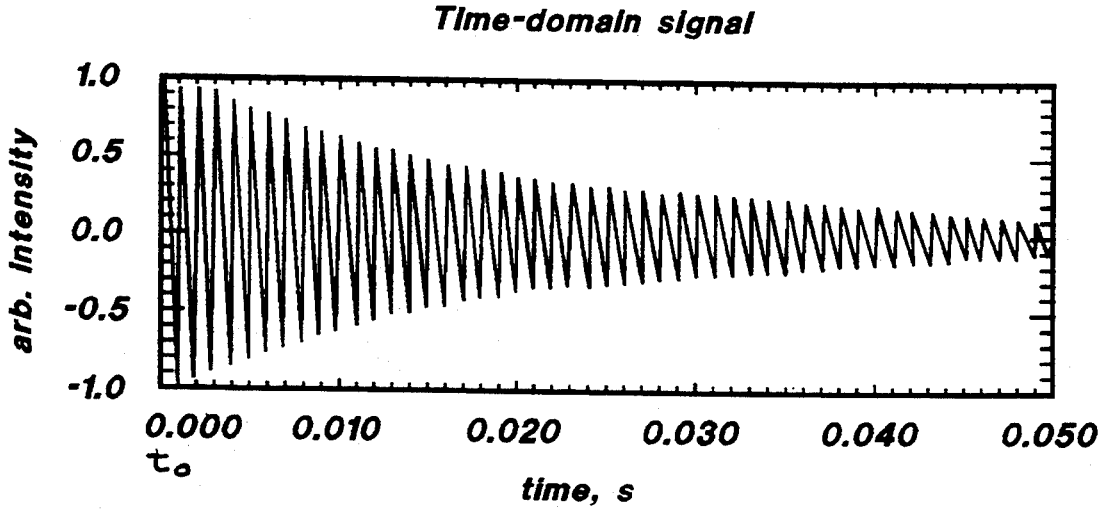
FIG. 2 is a idealized plot of the intensity as a function of time of a detected signal from a single species after excitation.

In the illustrative ICR mass spectrometer system of FIG. 1, a data input device 120, e.g., a keyboard, mouse, interactive graphics unit, or a magnetic media reader, receives data from the operator indicating the parameters of the selected time domain excitation signal which will give the user the desired mass domain excitation profile. The data received by the data input device 120 is provided to a programmable digital computer 119. The computer 119 controls an excite waveform generator 121. Under the control of the computer 119, the digital signal data from the generator 121 is read out to a digital-to-analog converter 124 which provides an analog output signal to a tunable low pass filter 125 which filters out frequencies in the analog signal which are above the frequencies of interest. The filter 125 thus functions as an output anti-aliasing filter. The system can also operate in a heterodyne mode in which the filter 125 would reject only frequencies above the excitation signal bandwidth (for example, 100 KHz). In the direct mode, a switch 306 is set in position A in FIG. 1 and a switch 309 is set in the position C in FIG. 1 such that the output of the filter 125 directly connects to a variable attenuator 129 which is preferably programmable to attenuate the signal by up to 64 dB in 0.1 dB steps. Alternatively, the system can operate in the heterodyne mode in which a high frequency carrier signal is provided from a tunable frequency synthesizer 307, which is under the control of the computer 119, to a mixer 308, and with the switch 309 switched to the position B in FIG. 1 to provide the output signal from the mixer 308 to the variable attenuator 129. The output of the mixer contains a double side-band amplitude modulated signal centered on the output frequency of the tunable frequency synthesizer 307. The output of the attenuator 129 is supplied to a power amplifier 133 which delivers a time varying voltage output signal on the lines 134 and 135 to the excitation electrodes 102 and 103, respectively, with the signals on the lines 134 and 135 being 180° out of phase with one another. The time varying voltage applied to the plates 102 and 103 produces a corresponding time varying electric field in the ICR cell which is oriented transverse to the applied magnetic field.

The tunable frequency synthesizer 307 may function in both the excite and receive modes. The switches 304($S_1$), 306($S_2$), and 309($S_3$) are set to the various positions shown in FIG. 1 depending on the excitation or receive mode. The received signal on the plates 107 and 108 is provided on lines 137 and 138 to a preamplifier 139 and through variable attenuator 129, an amplifier 321, and the switches to an analog-to-digital converter 145 and to a receive waveform memory 143 before being provided back to the computer 119. The output of the system as analyzed by the computer is displayed to the operator on the display unit 150.

The foregoing general structure of an ICR mass spectrometer is well known and described, for example, in the aforesaid U.S. Pat. Nos. 5,248,882, 4,945,234, and 4,761,545, which are incorporated herein by reference.

The present invention allows the determination of accurate relative ion abundances from the data from the detected ion cyclotron resonance signal which is also used to determine the ion species in accordance with, for example, Fourier transform mass spectrometry processing. The detected signal contains damped transient components corresponding to the ion species. The present invention utilizes processing carried out in the computer 119 or, if desired, in an optional dedicated wavelet analysis module 160, on the received data to isolate the intensity of a particular frequency, corresponding to a particular species, as a function of position or time within the transient signal. In accordance with the present invention, wavelet transforms are utilized to provide high efficiency isolation of the individual frequencies in the received signal that correspond to the individual species, and to do so in a manner which allows the relative ion abundances to be quantified. The basis for the wavelet transform analysis in accordance with the present invention is discussed below.

In considering the application of wavelet transforms in the present invention, it is helpful to begin with a review of the more familiar Fourier transform. Both wavelet transforms and Fourier transforms are integral transforms, but a significant difference makes the use of the wavelet transform in the present invention particularly advantageous.

An expression for the Fourier transform is $$F(s) = \frac{1}{\sqrt{2\pi}} \int_{-\infty}^{\infty} e^{-ist} f(t)dt, \tag{1}$$

where f(t) and F(s) are corresponding functions in the t-and the s-domains, respectively. Here, $e^{-ist}$ is called the kernel of the transform. This is equivalent to a linear combination of sines and cosines. Thus, the form of the kernel is fixed.

The wavelet transform differs from the Fourier transform in not being restricted to a particular kernel. In fact, the kernel may be chosen to be advantageous to a given application. One begins by choosing a mother wavelet function, $\Psi(t)$; the wavelet functions used in the transform are developed from the mother wavelet by dilations (changing the width of the mother wavelet) and translations (moving the dilated mother wavelet along the t-axis). Usually, the mother wavelet has a distinct region in which it is non-zero, and is zero everywhere else; this has the important ramification that wavelet analysis can be sensitive to where a feature occurs within a signal to be analyzed.

The general relation of the mother wavelet function $\Psi$ with a particular wavelet function $\Psi_{m,n}(t)$ is $$\Psi_{m,n}(t) = a_0^{-\frac{m}{2}} \Psi(a_0^{-m}t - nb_0), \tag{2}$$

where $a_0$ and $b_0$ are real numbers relating to dilations and translations, respectively. The integer m completes the description of the dilation, and the integer n completes the description of the translation. Thus, the mother wavelet $\Psi(t)$ is expanded or shrunk and moved along the t-axis to produce wavelet functions for the transform operation. In the discrete wavelet transform, this is accomplished by keeping $a_0$ and $b_0$ fixed and varying the integer variables m and n, which then serve as indices for the wavelet function $\Psi_{m,n}(t)$. The factor $a_0^{-m/2}$ on the right side of Equation (2) keeps the norms of the wavelet functions equal.

Figure 4:
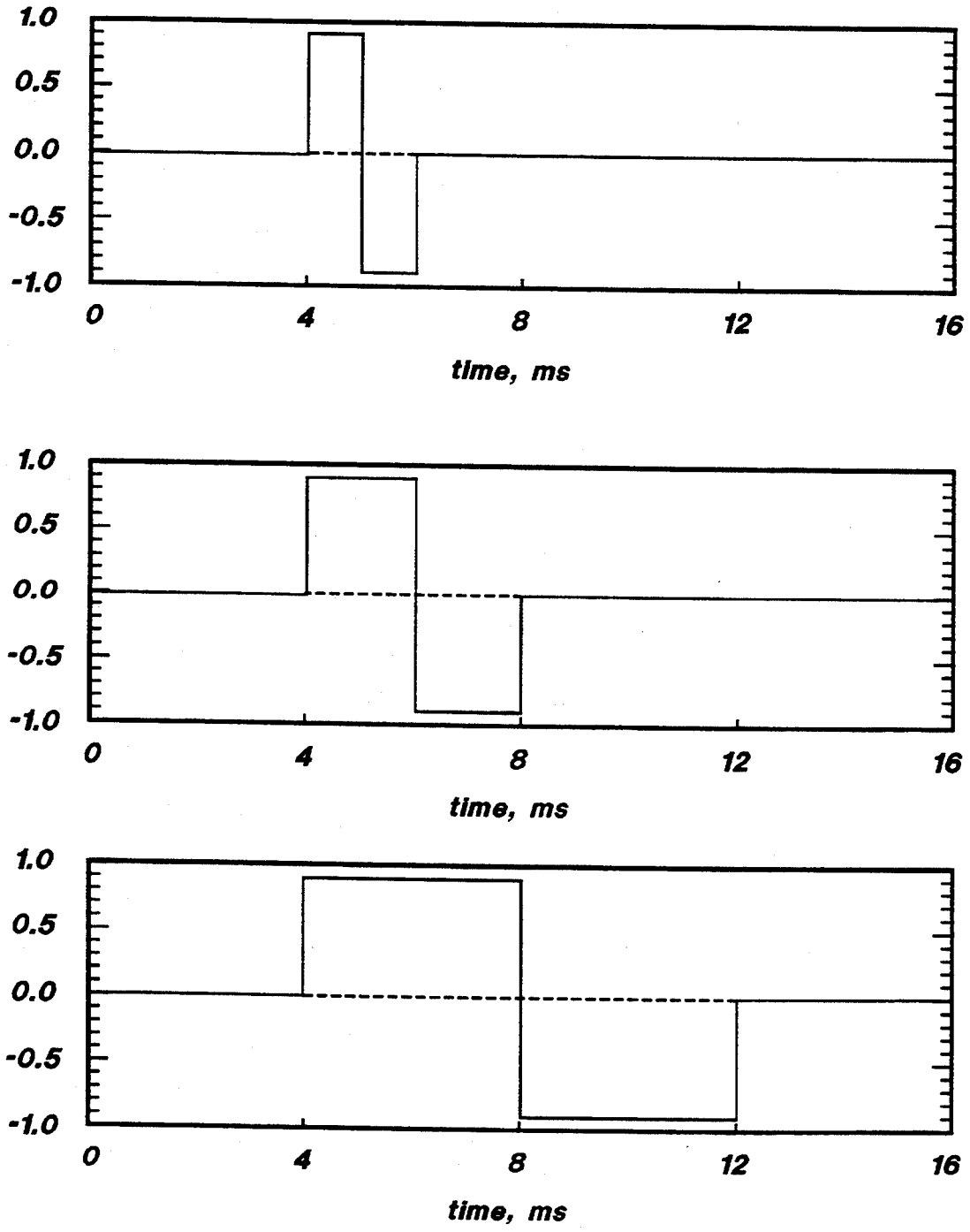
FIG. 4 are graphs showing exemplary Haar functions which may be utilized as the wavelet function in accordance with the present invention where the parameter affecting frequency in the wavelet function is varied.
Figure 5:
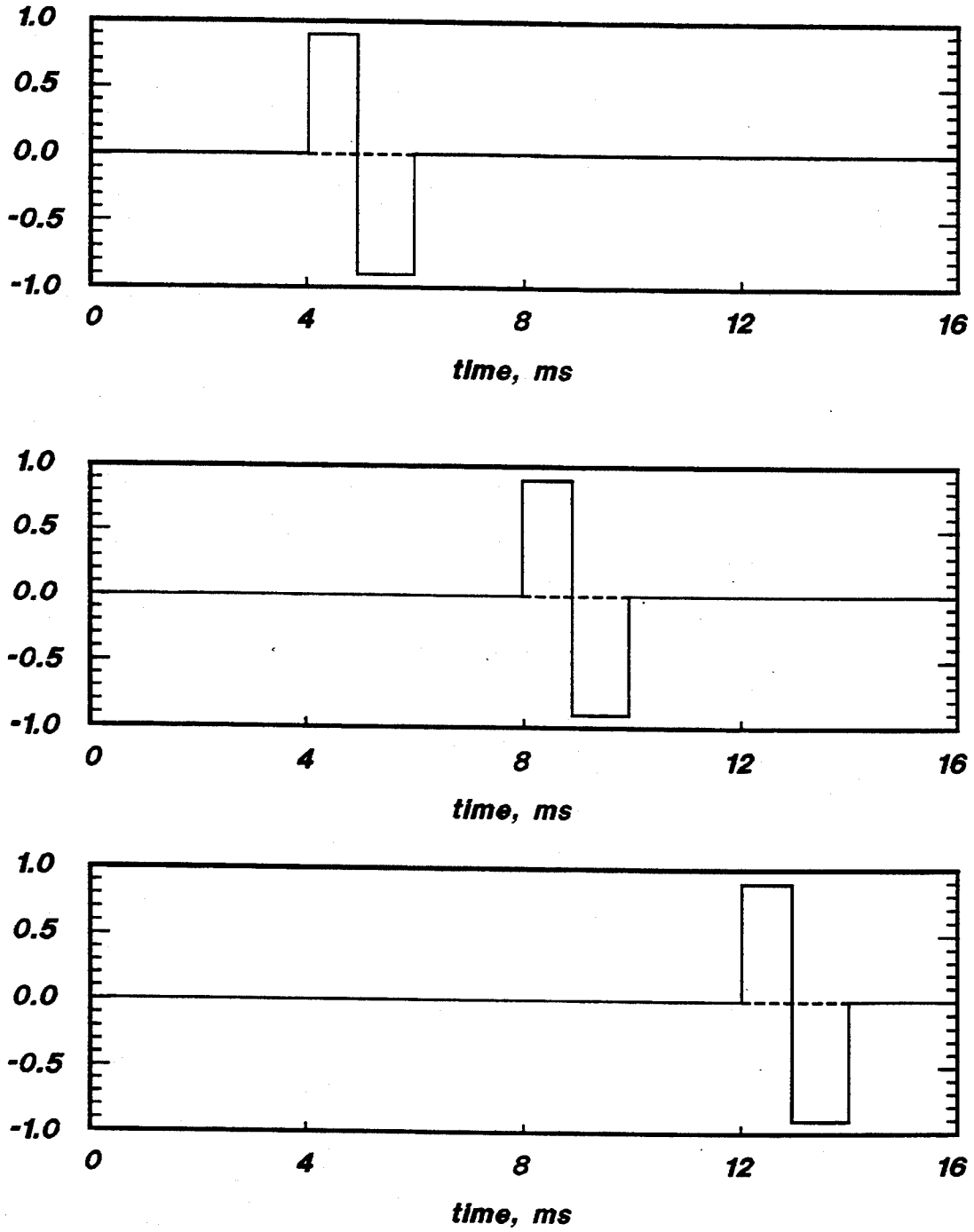
FIG. 5 are exemplary graphs of Haar functions as the wavelet function where the parameter affecting time localization in the wavelet function is varied.

If as the mother wavelet we choose the Haar function, i.e., $$\Psi(t) = \begin{cases} 1, & 0 \leqq t < \frac{1}{2} \\ -1, & \frac{1}{2} \leqq t < 1 \\ 0, & \text{otherwise} \end{cases} \tag{3}$$

and choose fixed $a_0$ and $b_0$, and vary m and n, dilations and translations of this wavelet function are illustrated, respectively, in FIGS. 4 and 5. For the Haar wavelets shown in FIGS. 4 and 5, the t-axis (the time axis) runs from 0 to 16 ms. For the example functions shown, $a_0=2.0$ and $b_0=0.5$.

FIG. 4 illustrates the unnormalized effect of varying m on the width of the non-zero part of the wavelet function (n is varied concurrently so that the left edge of the non-zero part remains fixed on the t-axis). The non-zero part of the wavelet function for m=2 is twice as wide as that for the case m=1; likewise, the width for m=3 is twice that of m=2. This illustrates that the width of the non-zero part of an analyzing wavelet function is related to a m equivalently, the frequency sensitivity of the wavelet function is related to $a_0^{-m}$.

FIG. 5 illustrates the time sensitivity of wavelet analysis. Here m is held fixed and n is varied. The three plots in FIG. 5 show the unnormalized Haar wavelet functions for n=4, 8, and 12. This has the effect of moving the non-zero part of the wavelet function along the t-axis. In fact, the left edge of the non-zero region is at $t=nb_0a_0^m$.

The wavelet transform $W_{m,n}(f)$ of f(t) can be written as:

$$W_{m,n}(f) = a_0^{-\frac{m}{2}} \int_{-\infty}^{\infty} \Psi(a_0^{-m}t - nb_0) f(t)dt. \tag{4}$$

The calculated wavelet coefficient $W_{m,n}(f)$ is indexed by m and n, so that each wavelet coefficient relates not only to the width of the non-zero part of the analyzing wavelet function (similar to the frequency sensitivity in the Fourier transform), but also to the position of the non-zero part of the analyzing wavelet function. Thus, one important advantage of the wavelet transform over the Fourier transform is time-frequency localization.

The present invention determines accurate ion abundances in Fourier transform mass spectra based on the time-frequency localization obtained utilizing wavelet transforms. First, the frequencies to be looked for in a transient response signal are determined, for example, by Fourier transform processing of the response signal data, and then $a_0$ and m are chosen to match the particular frequencies which are found in the response. Then, with $a_0$, m and $b_0$ fixed, n is scanned, calculating wavelet coefficients as in Equation (4) (in discrete form). These coefficients can be plotted as a function of time with respect to the transient signal. Because n is an integer and non-zero regions with different widths are used for frequency sensitivity, there will be fewer wavelet coefficients than data points in the transient. The time axis for the wavelet coefficients is derived from reference to FIG. 5, i.e., $$t_w = nb_0a_0^m, \tag{5}$$

where $t_w$ is subscripted to reinforce the fact that this is the time base for the wavelet coefficients, not for the transient itself.

A plot of the wavelet transform magnitude as a function of time essentially traces the course of the intensity of one particular frequency component within the transient. The function has a decaying exponential, and decay parameters are fitted to this exponential decay component. Because the time when excitation was turned off is known with respect to the time base defined by the start of the detection event, the intensity of the signal can be determined which is due to ions orbiting with a particular frequency when the excitation event ended. This analysis is repeated with the other ion species to determine intensities which can be compared to provide estimates of the relative ion abundances.

The wavelet analysis in accordance with the invention can be illustrated utilizing synthesized data which provides known magnitude signal components to allow the effectiveness of the process to be ascertained. In the example described below, both data generation and analysis used PV-WAVE, a visual data analysis software package produced by Visual Numerics. This package offers extensive mathematical functions, convenient handling of vectors, flexible plotting capabilities, and a full-featured programming language.

Figure 6:
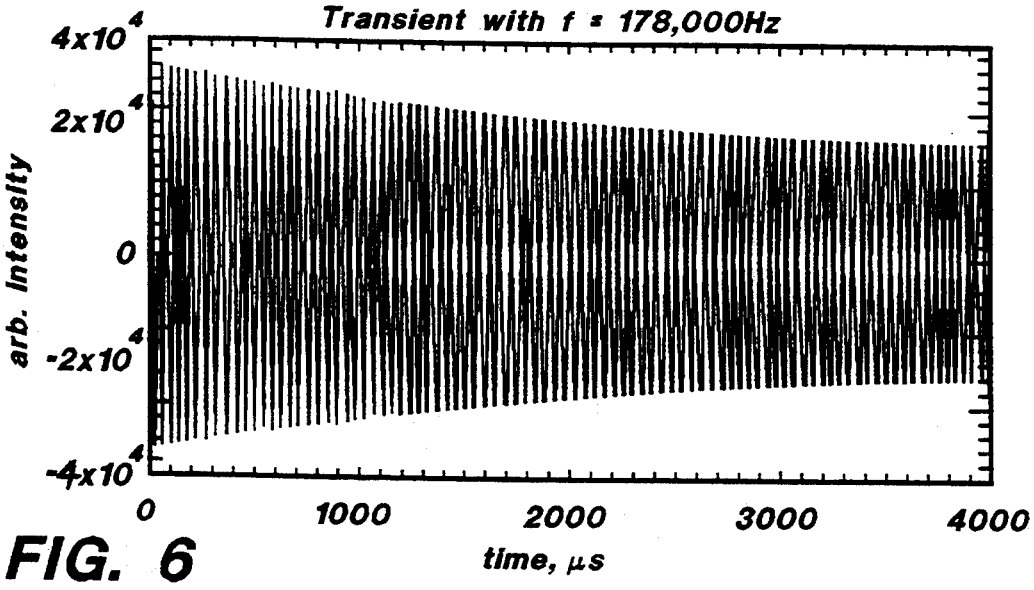
FIG. 6 is an exemplary graph of an idealized detected transient signal for a single species having an ion frequency of 178,000 Hzo
Figure 7:
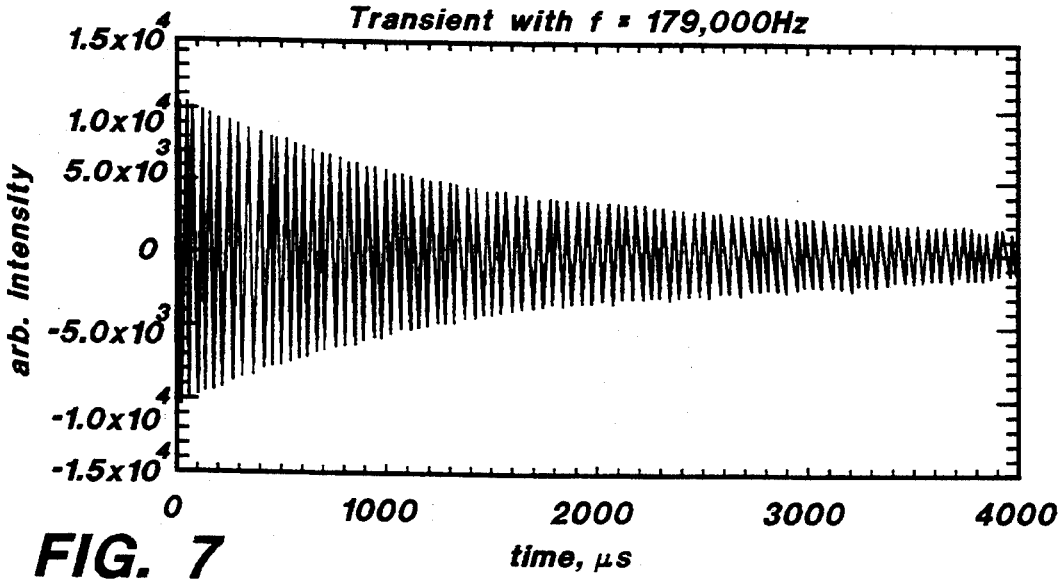
FIG. 7 is an exemplary graph of an idealized detected transient signal for a single species having an ion frequency of 179,000 Hz.
Figure 8:
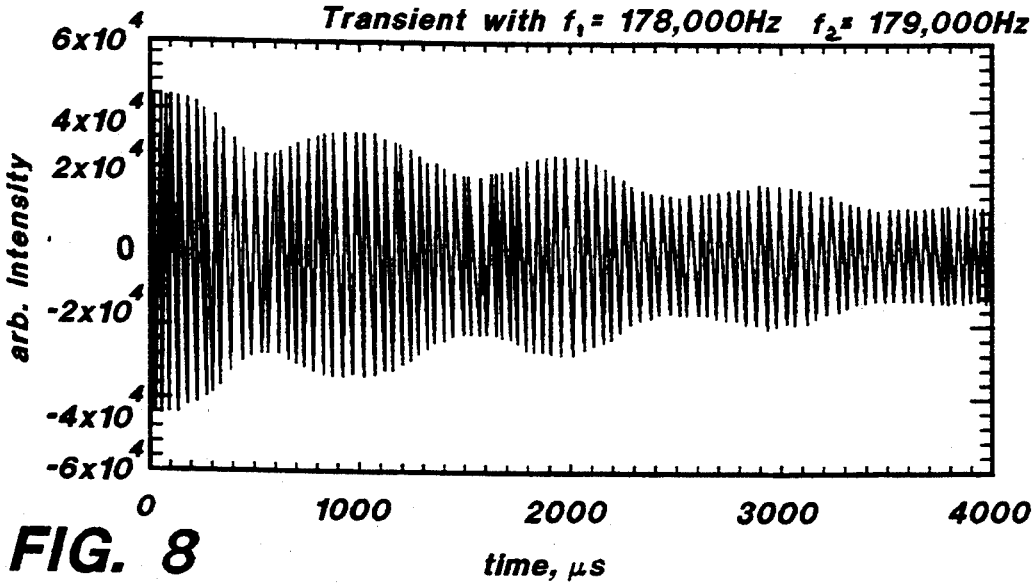
FIG. 8 is a graph showing a detected transient signal with both of the species of FIGS. 6 and 7 in the sample so that the signals from each of these species are superimposed.

Synthetic transients were generated to mimic a real Fourier transform mass spectrometry signal. generation was carried out as follows: Choose "acquisition" parameters, e.g., number of points and sampling rate. From this a time base can be determined, and a frequency is picked and a sine wave generated over that time range. Signal values are now between −1 and 1. Next, pick a decay rate, i.e., a lifetime. Generate an exponentially decaying window over the same time base and multiply the signal from the last step by this window. Use a random number generator function to produce a vector of noise over the same time base. Scale in the Y-direction appropriately for a desired level of noise and add to the synthetic signal. Scale the damped, noisy transient in the Y-direction as desired. This now provides a synthetic transient containing one non-noise frequency. If a signal containing two non-noise frequencies is desired, two transients can be added in the above step. This second signal can be damped and scaled differently before adding to the first to mimic different ion abundances and decay rates. FIGS. 6 and 7 show the signal components at two different frequencies, and FIG. 8 shows the sum of these components.

Wavelet analysis may then be carried out in the computer with a program written in the PV-WAVE programming language. In carrying out the invention, the frequencies of the various ion species in the transient can be determined by normal Fourier transform MS processing and peak-finding in the frequency domain. The PV-WAVE program used for calculating wavelet coefficients as in Equation (4) is described below. In this program the wavelet function used is the Haar function, but it is understood that many other wavelet functions can be used in the invention. The Haar function may be calculated by the computer in accordance with the following program (with comments):

```
;   Function:
;     haar    --  Generated Haar wavelet basis vector.
;   Input parameters:
;     time    --  time vector
;     m       --  fixed scalar; along with a0, determines
;                 width of non-zero part of basis vector
;     n       --  fixed scalar; along with b0, determined
;                 position along time-axis of non-zero
;                 part of basis vector
;     a0      --  fixed scalar; along with m, determined
;                 width of non-zero part of basis vector
;     b0      --  fixed scalar; along with n, determines
;                 position along time-axis of non-zero
;                 part of basis vector
;   Output parameters:
;     phi     --  Haar basis vector
;   Mechanism:
;     Return Haar wavelet basis vector, phi
;                 1, 0 <= x < 0.5
;       phi =     -1, 0.5 <= x < 1
;                 0, otherwise
;     where x is the shifted and dilated time array, here
;       x = time * a0    (-m) - n * b0
FUNCTION haar, time, m, n, a0, b0
        ; Let PV-WAVE handle its own errors.
      ON-ERROR, 2
        ;   Set up default values for unspecified variables.
      IF ( NOT N_ELEMENTS ( m ) ) THEN m = 0
      IF ( NOT N_ELEMENTS ( n ) ) THEN n = 0
      IF ( NOT N_ELEMENTS ( a0 ) ) THEN a0 = 2.d
      IF ( NOT N_ELEMENTS ( b0 ) ) THEN b0 = 1.d
;     Figure out shifted and dilated time array, x.
      x = time * a0    (-m) - n * b0
;     Now figure out Haar wavelet.
      len = N_ELEMENTS ( time )
      phi = DBLARR ( len )
      index = WHERE ( x GE 0. AND x LT 0.5, count )
      IF ( count GT 0 ) THEN phi ( index ) = 1.d
      index = WHERE ( x GE 0.5 AND x LT 1., count )
      IF ( count GT 0 ) THEN phi ( index ) = -1.d
;     Return Haar vector and quit.
      RETURN, phi
      END
```

A program utilizing the Haar function as above to determine the discrete wavelet transforms is set forth below:

```
;   Function:
;     nscanh  -- Returns a vector describing the time-
;                dependence of a particular frequency
;                component in a signal, by using the Haar
;                wavelet basis.
;   Input parameters:
;     signal  -- signal vector to be analyzed
;     time    -- time vector for signal vector
;     m       -- fixed scalar; along with a0, determines
;                frequency component to be extracted from
;                signal
;     a0      -- fixed scalar; along with m, determines
;                frequency component to be extracted from
;                signal
;     b0      -- fixed scalar; along with n (which is varied
;                in this function, see below), moves non-zero
;                part of analyzing vector across signal
;                vector
;   Output parameter:
```

-continued

```
;     response -- vector containing scalar products of
;                 signal with analyzing vector, as a
;                 function of n
;   Dependencies:
;     Requires haar.pro
;   Mechanism:
;     Varies a parameter (n) to move non-zero part of
;     analyzing wavelet vector across the signal to be
;     analyzed. For each n, assigns scalar product of
;     analyzing wavelet vector and signal to an element of
;     the response vector. The size of the response vector
;     thus depends on the number of valid n's.
;       With a set width for the non-zero part of the
;     Haar vector (determined by m and a0), we move the
;     non-zero part across the signal to be analyzed by
;     varying n with a set b0.
;       The number of valid n's depends on the width of
;     the non-zero part, since the next n is selected such
;     that its non-zero part butts against, but does not
;     overlap, the non-zero part of the previous n. Hence,
;     the response vector's size depends on m, a0, and b0.
FUNCTION nscanh, signal, time, m, a0, b0
      ; Let PV-WAVE handle its own errors.
      ON_ERROR, 2
      ; Check lengths of the signal data vector and the
      ; associated time vector.
      len = N_ELEMENTS ( signal )
      IF ( len NE N_ELEMENTS ( time ) ) THEN BEGIN
      PRINT,
          'Signal and time arrays do not match.'
          RETURN, -1
      ENDIF
;         Calculate low and high values for n.
;         The prescription for getting a particular wavelet
;         vector from the mother wavelet
;                phi ( x )
;     is
;                phi ( x * a0   (-m) - n * b0
;     Here we have m, a0, and b0 fixed, and will vary n as
;     an integer. The range for n depends on the width of
;     the non-zero part (determined by m and a0); there's no
;     point in letting the non-zero part get pushed to times
;     longer than are in signal. The time for the start of
;     the non-zero part is given by
;              t = a0   m * n * b0
;         So nhi will coincide with t = len in this
;         equation.
      nlo = 1
      nhi = FIX( len * a0   (-m) / b0 )
;         Allocate memory for response vector that will be
;         returned.
      ncount = ( nhi - nlo ) / 2 + 1
      response = FLTARR ( ncount )
;         Go through valid n's, filling up response vector
;         as we go. First generate analyzing wavelet
;         vector by calling haar( ) function, then calculate
;         scalar product of this wavelet vector with the
;         signal vector.
      i = 0
      FOR n = nlo, nhi, 2 DO BEGIN
          phi = haar ( time, m, n, a0, b0 )
          response ( i ) TOTAL ( phi * signal )
          i = i + 1
          PRINT, 'Operation', i, 'of', ncount, 'done.'
      ENDFOR
;         Return response vector and quit.
      RETURN, response
      END
```

Knowing the frequencies of interest in the transient, $a_0$ and m are chosen so that the width of the non-zero part of the wavelet function matches the period of the signal component looked for. Then with an appropriate choice for $b_0$, usually 1, the maximum value that n can have with the non-zero part of the wavelet function still within the time base is determined. Then the integer n is varied from 1 to its maximum value (in the program above the step size is two), which pushes the non-zero part of the wavelet function across the time base (e.g., see FIG. 5). The wavelet coefficients developed as in Equation (4) are returned in a vector from this program.

Figure 9:
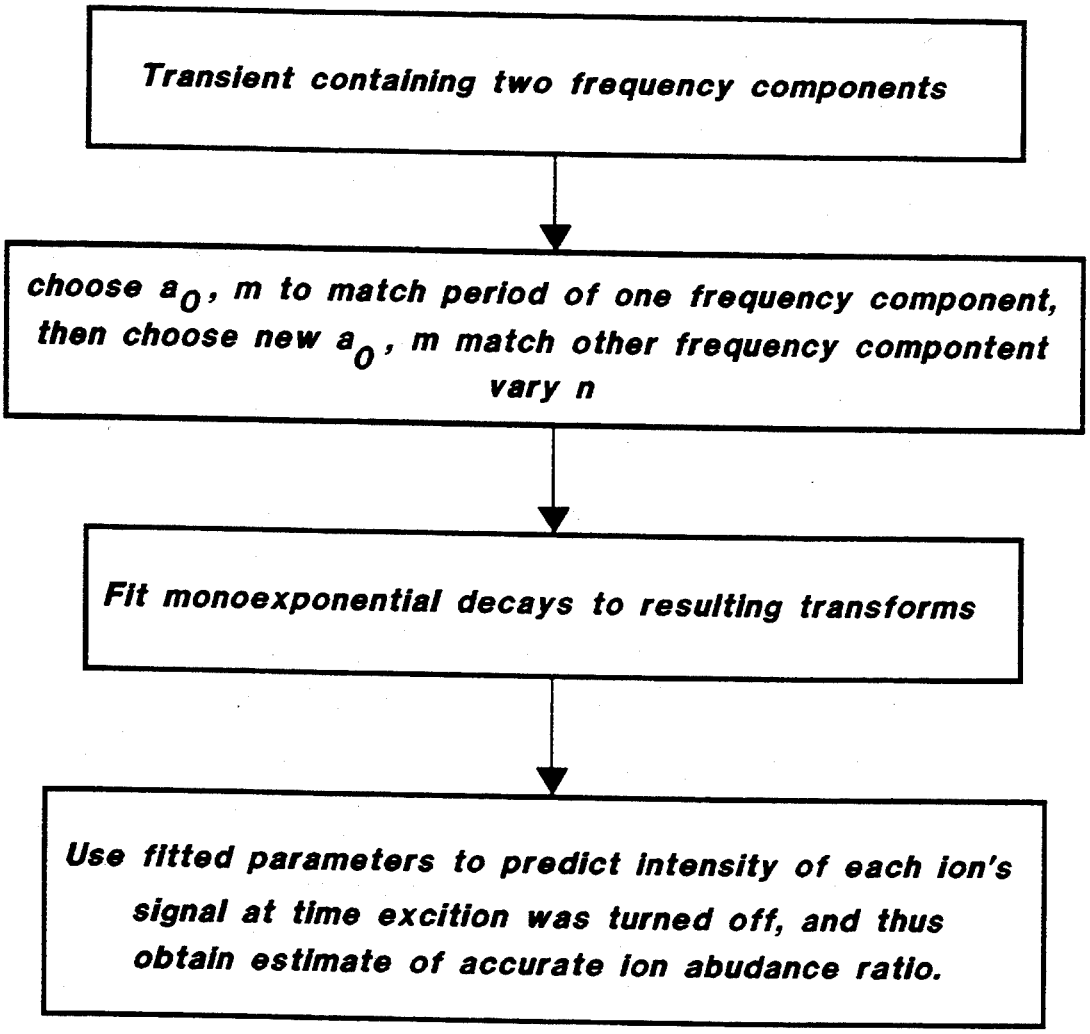
FIG. 9 is a chart which illustrates the steps carried out in the apparatus of FIG. 3 for wavelet analysis of MS transients in accordance with the invention.

A PV-WAVE function may then be utilized to do a least-squares fit of the natural logarithms of the wavelet coefficients to a straight line. This yields fit parameters corresponding to the decay rate and the intensity of the wavelet coefficient at zero time (noting that the time values used in plotting the wavelet coefficients; are given by Equation (5)). From the experiment setup, the time when excitation was shut off with respect to the start of detection is known, and by referencing this to time values from Equation (5), ion abundances can be calculated at the time that excitation was turned off. A flowchart for this process is shown in FIG. 9.

Exemplary results of this process for the analysis of the synthetic transients of FIGS. 6–8 are shown in FIGS. 10–13. One transient component, denoted Transient 1 and shown in FIG. 6, was generated with a single frequency component; here the frequency $f_1=178{,}000$ Hz and the initial intensity $i_1=30{,}000$ arbitrary units. A second one-frequency component transient, denoted Transient 2, shown in FIG. 7, was generated with frequency $f_2=179{,}000$ Hz and initial intensity $i_2=10{,}000$. A third transient, denoted Transient 3 and shown in FIG. 8, is the sum of Transients 1 and 2.

Figure 10:
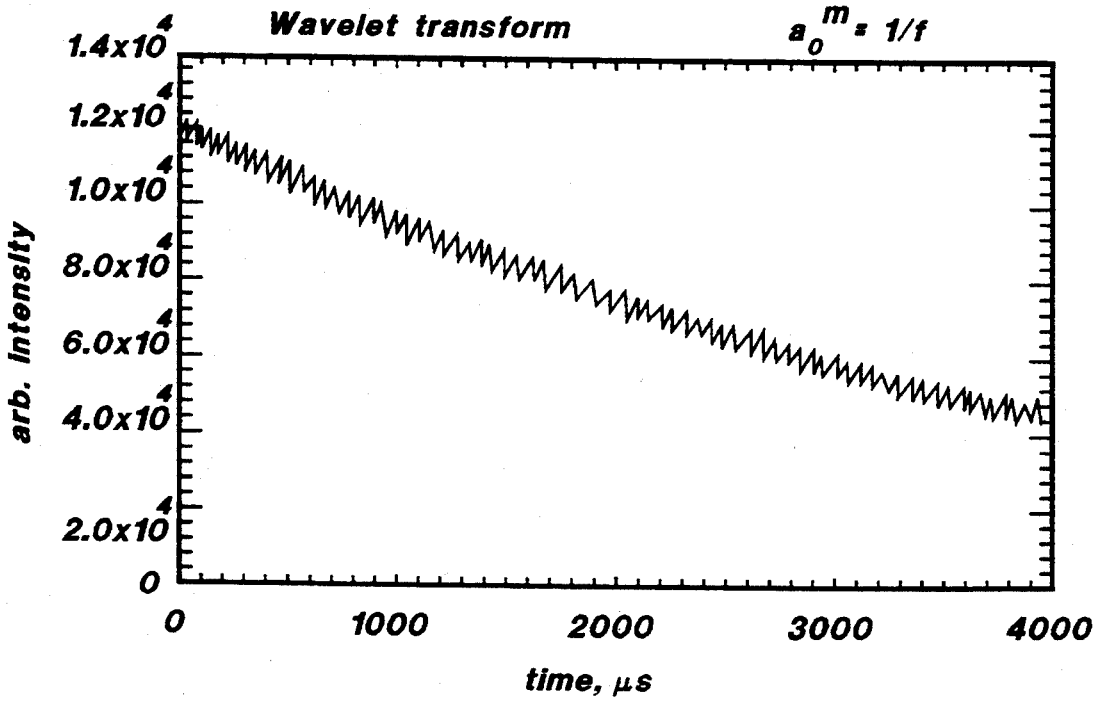
FIG. 10 is an exemplary graph showing the wavelet transform of the single frequency transient signal of FIG. 6.
Figure 11:
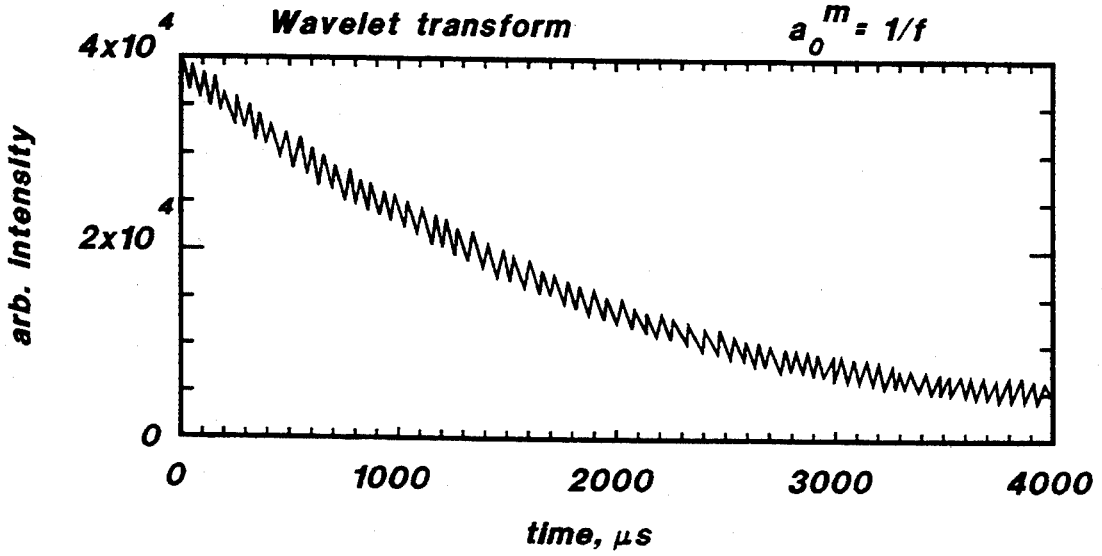
FIG. 11 is a graph showing the wavelet transform of the signal frequency transient signal of FIG. 7.

FIG. 10 is a plot of the wavelet coefficients for Transient 1 as determined by Equation (4). The small oscillations in the wavelet coefficient plot are apparently caused by beating of the sampling frequency (acquisition rate) against the signal frequency. The fitted equation relating wavelet coefficient intensity as a function of time along the wavelet coefficient plot is $\log(WT)=11.67-0.0002447t_n$. From this equation the initial intensity of the wavelet coefficients can be determined, which is directly proportional to initial signal intensity of this frequency component in the transient. More usefully, the intensity at a negative time can be calculated, corresponding to the instant that the excitation was turned off. FIG. 11 shows a similar wavelet coefficient plot for frequency 179,000 Hz in Transient 2. The fitted equation to this plot is $\log(WT)=10.57-0.0004886t_n$.

Figure 12:
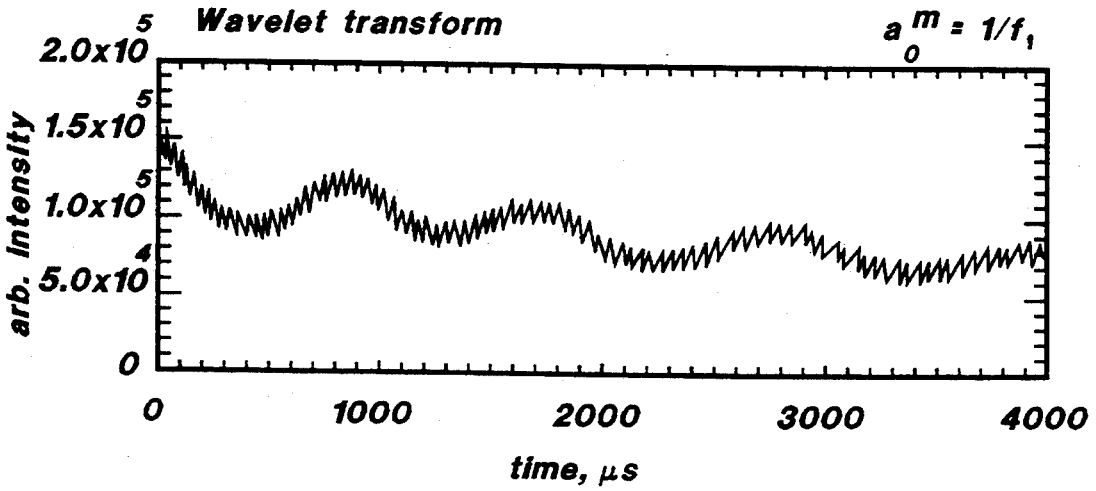
FIG. 12 is a graph showing the wavelet transform of the transient signal containing two frequencies corresponding to two detected species which is illustrated in FIG. 8, with the wavelet function selected to match the frequency of the transient of FIG. 6.
Figure 13:
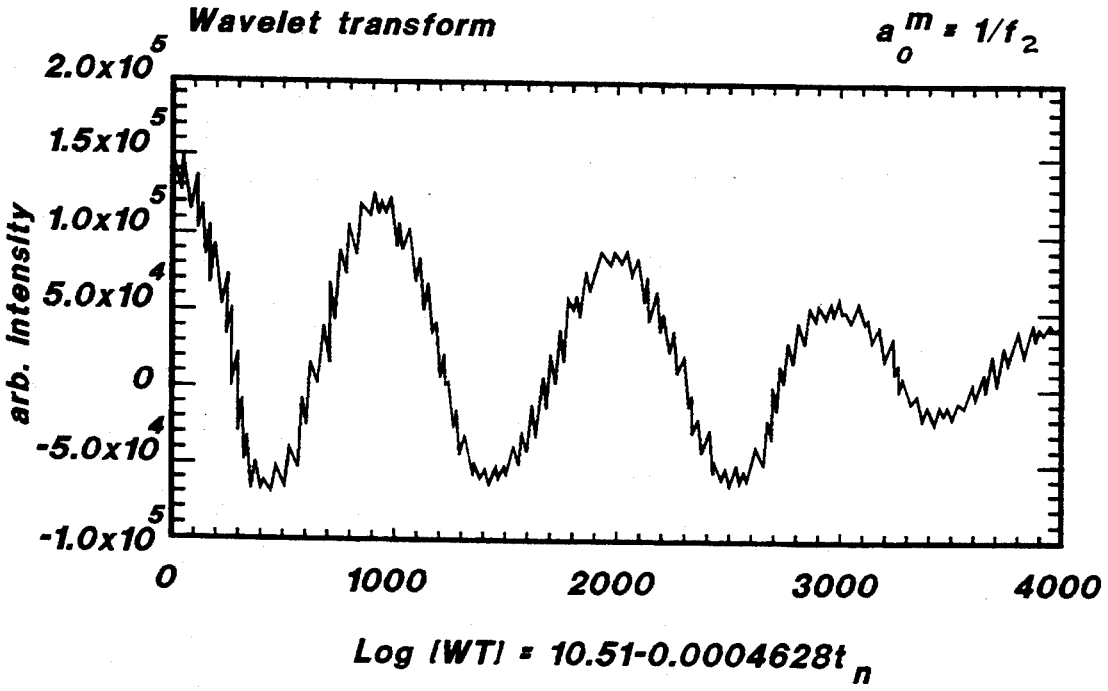
FIG. 13 is a graph showing the wavelet transform of the transient signal of FIG. 8 with the wavelet function selected to match the frequency of the transient of FIG. 7.

FIG. 12 shows the wavelet coefficient plot of Transient 3 (containing two frequency components) for the component of frequency $f_1=178{,}000$ Hz. In spite of the $\approx 1{,}000$ Hz oscillation (apparently caused by the beating of the 178,000 Hz component against the 179,000 Hz component), the parameters of the fitted equation, $\log(WT)=11.66-0.0002403\,t_n$, are seen to agree very well with those from FIG. 10. Similarly, the parameters determined for the plot of FIG. 13 for extracting the 179,000 Hz signal from Transient 3, $\log(WT)=10.51-0.0004628t_n$, are in good agreement with those determined for FIG. 11.

Table 1 below summarizes these results. Working down the table, one can compare how effectively frequency $f_1$ can be extracted from the two-component signal; the error introduced by the presence of the second frequency component is less than one percent, regardless of whether one looks at the start of the transient (time=0 μs, middle column) or whether one extrapolates back to some negative time (say, t=−600 μs, right column) where it is assumed the excitation had been turned off (because the initial intensity and the decay rate that were used to generate Transient 1 are known, the intensity at negative times can be calculated). A similar summary is provided for frequency $f_2$. Here, perhaps because the initial intensity of this component is three times less than that of the other component, the errors associated with determining the component with frequency $f_2$ are larger (on the order of five to seven percent).

TABLE 1

Predicting Signal Intensities from Wavelet Analysis Fit Parameters

| | time=0μs | time=−600μs |
|---|---|---|
| Intensity of $f_1$ from one-frequency signal | 117,170 | 135,700 |
| Intensity of $f_1$, from two frequency signal | 116,320 | 134,358 |
| Error, percent | −0.73 | −0.99 |
| Intensity of $f_2$ from one-frequency signal | 38,778 | 51,987 |
| Intensity of $f_2$ from two-frequency signal | 36,725 | 48,481 |
| Error, percent | −5.29 | −6.74 |
| Ratio of intensities of $f_1$:$f_2$ in two-frequency signal | 3.17 | 2.77 |
| Error, percent | 5.58 | 6.95 |

The bottom of Table 1 gives the ratio of the intensities of the two components as determined from Transient 3. The ratio of components corresponding to $f_1$ and $f_2$ should be 3.00:1 at t=0 μs, and one can calculate that the ratio at t=−600 μs should be 2.59:1. The error in the estimated ratio is about 5.5 percent at t=0 μs, and about seven percent at t=−600 μs. The errors in the ratio determination naturally reflect the errors in the determinations of the individual components in the component transient. This exemplary transient data is an extreme case of the two components having different decay rates; the ratio of peak heights in a magnitude-mode spectrum for these two frequency components is 4.76:1.

As indicated above, many different functions can be used as the mother wavelet function. One function which is preferable for some applications is based on the second derivative=of the Gaussian function, e.g., the negative of the second derivative of $x(t)=e^{-t2/2}$ $$\Psi(t)=(1-t^2)\exp(-t^2/2). \tag{6}$$

The wavelet function for this mother wavelet may be expressed as:

$$\Psi_{m,n}(t) = a_0^{-\frac{m}{2}}[1-(a_0^{-m}t-nb_0)^2]\exp[a_0^{-m}t-nb_0)^2/2] \tag{7}$$

Figure 14:
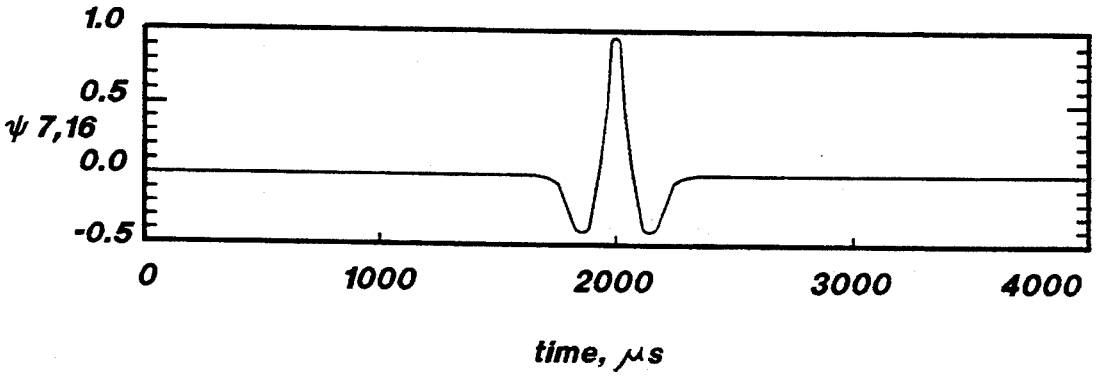
FIG. 14 is a graph showing another exemplary wavelet function which is based on the second derivative of the Gaussian function.
Figure 15:
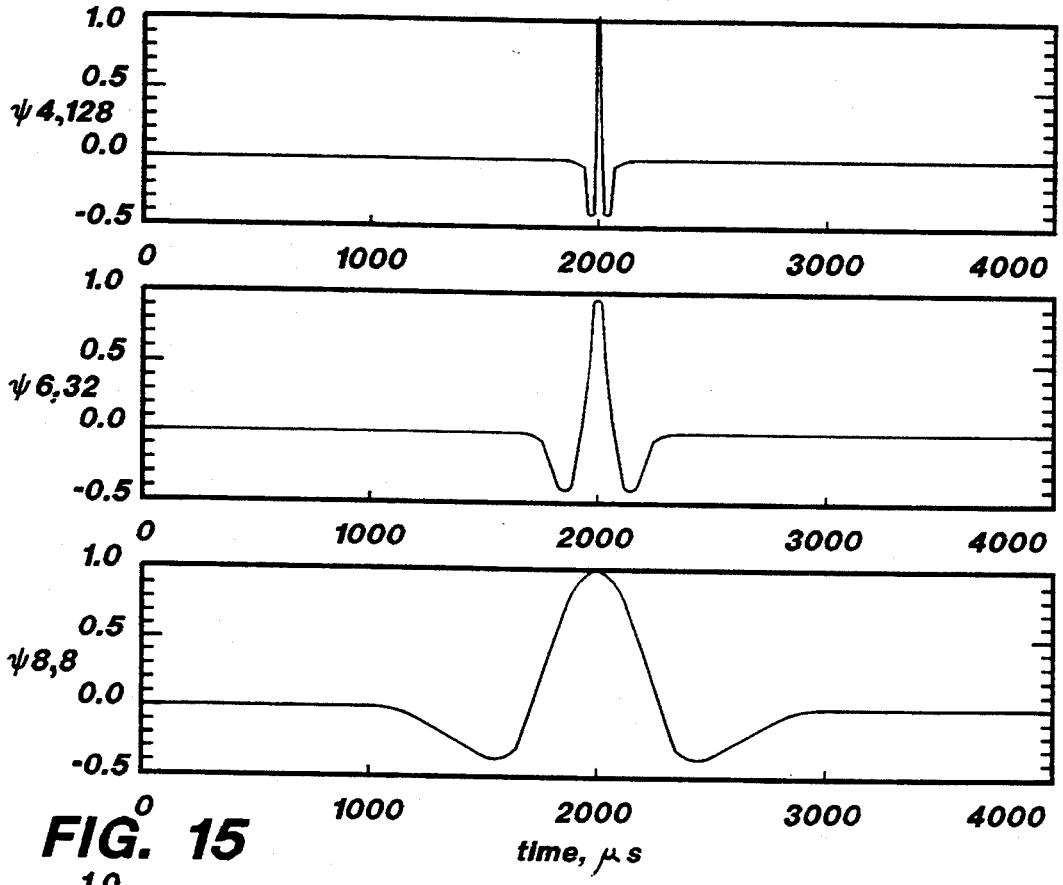
FIG. 15 are exemplary graphs of wavelet functions based on the second derivative of the Gaussian function where the parameter effecting frequency in the wavelet function is varied.
Figure 16:
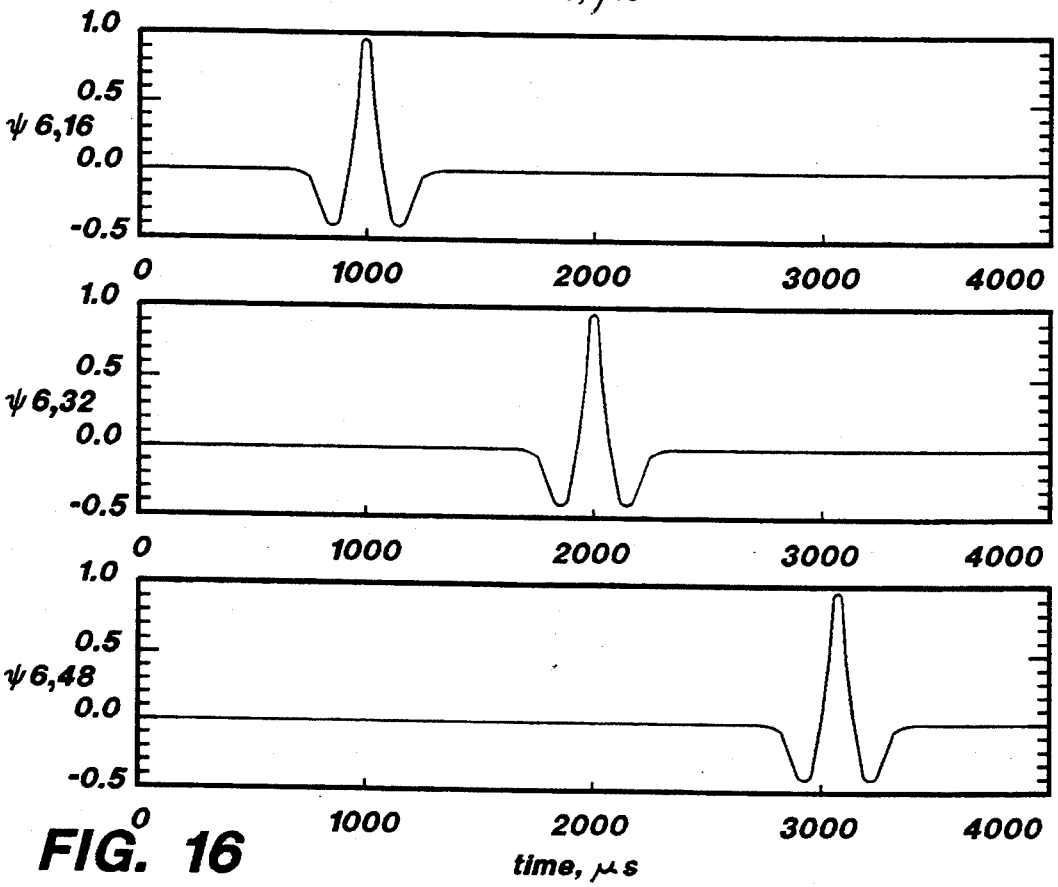
FIG. 16 are exemplary graphs of wavelet functions based on the second derivative of the Gaussian function where the parameter affecting time localization in the wavelet function is varied.

The wavelet for this function for $a_0=2.0$, $b_0=1.0$ and m=7, n=16 is shown in FIG. 14. FIG. 15 shows the frequency sensitivity (i.e., dilation) of the wavelet basis function shown in FIG. 14. This shows how by varying m the width of the non-zero portion of the wavelet can be varied to match the frequency of the transient signal to be analyzed. FIG. 16 shows the time sensitivity (i.e., translation) of the wavelet basis function shown in FIG. 14. This illustrates that by varying n the non-zero part of the wavelet can be made to traverse the time domain of the transient signal to be analyzed.

The use of the foregoing wavelet basis function may be illustrated with data taken on a sample composed of 2-chlorotoluene. In addition to being easy to introduce to a mass spectrometer and ionize, this sample material has the advantages of producing abundant molecular ions and having a simple, well defined isotope pattern.

To acquire the data set, 2-chlorotoluene was admitted through a batch inlet to an ion source 110 with a pressure of $2\times10^{-7}$ Torr. This gave an analyzer cell 101 pressure of $2\times10^{-9}$ Torr. The experimental sequence included electron ionization in the ion source 110 with 70 eV electrons at an emission current of 5 micro-amps for 5 ms. During this time, the conductance limit was grounded to allow the ions formed in the ion source cell 110 to transfer to the analyzer cell 101. Subsequent excitation and detection events were done in the analyzer cell 101. First, an excitation waveform was used to eject ions with mass to charge (m/z) ratios of less than 126. Then, a highly frequency selective, tailored excitation waveform implemented as described, e.g., in U.S. Pat. No 4,761,545 using and Extrel FTMS mass spectrometer equipped with a SWIFT(TM) module, was used to apply excitation power such that only ions in the mass range from m/z 125.5–m/z 128.5 were excited to a uniform radius sufficient for detection. Following a delay of 600 microseconds after the excitation event ended, the signal from the orbiting ions was detected in the analyzer cell 101 by collecting 65,536 points at a rate of 4 million samples per second. The end trapping plates were maintained at 2 volts throughout.

It may be noted that the level of excitation energy given to the ions is not critical provided that ions of different mass to charge ratio are excited to about the same radius, which is readily carried out by tailored excitation utilizing the Extrel FTMS SWIFT module. However, if the ions are excited to too large a radius, some or all may hit the cell plates and be lost which will render the detected signal nonlinear with respect to the number of ions created. Low levels of excitation are generally acceptable, as signal averaging can be used since the signal from. a particular mass to charge ratio ion should be in phase from scan to scan.

Figure 17:
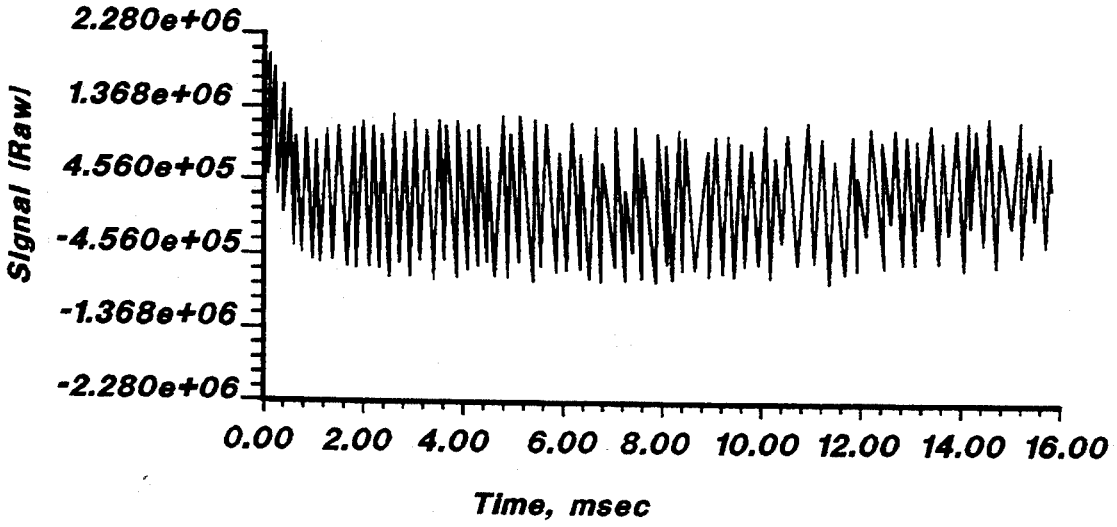
FIG. 17 is a graph showing a detected transient signal resulting from excitation and detection of 2-chlorotoluene.
Figure 18:
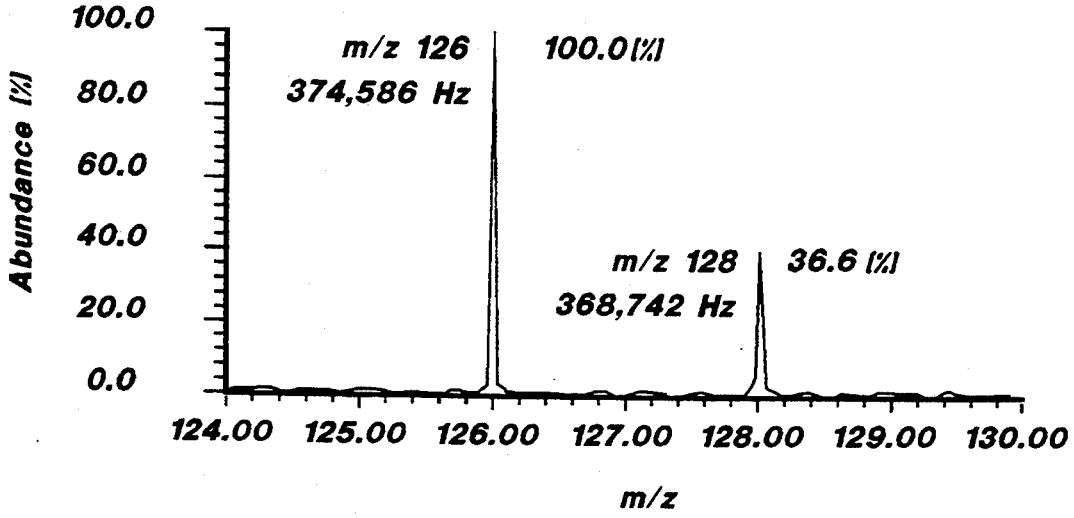
FIG. 18 is a graph showing the spectrum resulting from a normal Fourier transform mass spectrometry processing of the transient of FIG. 17.

The transient resulting from this detection sequence is shown in FIG. 17. FIG. 18 shows the spectrum resulting from a normal Fourier transform MS processing of this transient. The spectrum is labeled with m/z values and relative peak heights. The abundance of the m/z 128 ion is shown to be 36.6% compared with the m/z 126 ion. The abundance of the m/z 128 ion should be 32.0% compared with the m/z 126 ion; thus, 36.6% represents about 14.4% error in the determination of the relative abundance.

Wavelet analysis of the transient may be carried out in the computer 119 (or the module 160) with a program written in the PV-WAVE programming language. The PV-WAVE program used for calculating wavelet coefficients for the wavelet function as in equation (7) (for simplicity, referred to as a "hat" function from its shape), is provided below (with comments):

```
;   Function:
;       hatfcn      -- Returns a vector containing the
;                      "hat" wavelet basis function.
;                      Mother wavelet:
;                        Y(s) = (1 - s*s) * exp (-s*s/2)
;   Input parameters:
;       s       -- time base (floating-point vector)
;       n       -- integer scalar
;       m       -- integer scaler
;       aO      -- floating-point scalar
;       bO      -- floating-point scalar
;   Output parameters:
;       y       -- hat function calculated from Mother
;                  wavelet using shifted, dilated time
;                  base determined with m, n, a0, b0
;                  (floating-point vector)
```

-continued

```
;   Dependencies:
;       none
FUNCTION hatfch,s,m,n,a_0,b_0
;   Return hat function,
;       y = (1 - t  2) * exp (-t  2 / 2)
;   where t is time, here
;       t = s * a_0  (-M) -n * b_0
    ON_ERROR, 2
    ; Set up default values for unspecified variables.
    ;
    IF (NOT N_ELEMENTS (m) ) THEN m = 0
    IF (NOT N_ELEMENTS (n) ) THEN n - 0
    IF (NOT N_ELEMENTS (a_0) ) THEN a_0 = 2.d
    IF (NOT N_ELEMENTS (b_0) ) THEN b_0 = 1.d
    ; Figure out "shifted time array".
    sta = s * a_0   (-m) - n * b_0
    ; Here's the part for calculating the hat function.
    xx = sta * sta
    y = (1.d - xx) * exp (- xx/2.d)
    RETURN, y
    END
```

A program utilizing the function as above to determine the discrete wavelet transforms is set forth below:

```
;   Function
;       nscanhat    -- Returns a vector describing the
;                      time-dependence of a particular
;                      frequency component in a signal,
;                      by using the hat wavelet basis.
;   Input parameters:
;       signal      -- signal vector to be analyzed
;       time        -- time vector for signal vector
;       m           -- fixed scalar; along with a0,
;                      determines frequency component to
;                      be extracted from signal
;       a0          -- fixed scalar; along with m,
;                      determines frequency component to
;                      be extracted from signal
;       b0          -- fixed scalar; along with n (which
;                      is varied in this function, see
;                      below), moves non-zero part of
;                      analyzing vector across signal
;                      vector
;       offset      -- fraction of a0 to shift time base
;                      in wavelet basis function--this is
;                      equivalent to doing a phase shift
;                      relative to the signal array
;   Output parameters;
;       ncount      -- number of wavelet coefficients
;                      calculated (optional)
;       response    -- vector containing scalar products
;                      of signal with analyzing vector,
;                      as a function of n
;   Dependencies:
;       Requires hatfcn.pro
;   Mechanism:
;       Varies a parameter (n) to move non-zero part of
;       analyzing wavelet vector across the signal to be
;       analyzed. For each n, assigns scalar products of
;       analyzing wavelet vector and signal to an element
;       of the response vector. The size of the response
;       vector thus depends on the number of valids n's.
;   The number of valid n's depends on the width of the
;   non-zero part, since the next n is selected such that
;   its non-zero part butts against, but does not overlap,
;   the non-zero part of the previous n. Hence, the
;   response vector's size depends on m, a0, and b0.
FUNCTION nscanhat, signal, time, m, a0, b0, offset,
    ncount=ncount
    ;   Let PV-WAVE handle its own errors.
    ON_ERROR, 2
    ;   Check lengths of the signal data vector and the
    ;   associated tune vector.
    len = N_ELEMENTS (signal)
    IF (len NE N_ELEMENTS (time)) THEN BEGIN PRINT,
        'Signal and time arrays do not match.'
        RETURN, -1
```

-continued

```
ENDIF
;    Calculate low and high values for n.
;    The prescription for getting a particular wavelet
;    vector from the mother wavelet
;                    phi (x)
;    is
;                    phi (x * a0  (−m) − n * b0)
;    Here we have m, a0, and b0 fixed, and will vary n
;    as an integer. The range for n depends on the
;    width of the non-zero part (determined by m and
;    a0); there's no point in letting the non-zero
;    part get pushed to times longer than are in
;    signal.
nlo = 1
nhi = FIX (time (len-1) * a0  (−m) / bo)
;    Allocate memory for response vector that will be
;    returned.
incr = 8
ncount = (nhi − nlo) / incr + 1
response = FLTARR (ncount)
PRINT, ncount, 'wavelet coefficients to calculate. . .'
;  Go through valid n's, filling up response vector as
;    we go. First generate analyzing wavelet vector
;    by calling hatfcn ( ), then calculate scalar
;    product of this wavelet vector with the signal
;    vector.
i = 0
IF (NOT KEYWORD_SET (offset)) THEN offset = 0
FOR n = nlo, nhi, incr DO BEGIN
     phi = hatfcn (time+offset*a0, m, n, a0, b0)
     response (i) = TOTAL (phi * signal)
     i = i + 1
ENDFOR
;  Return response vector and quit.
RETURN, response
END
```

To analyze this transient, a 16,384 point segment that began at 750 microseconds from the beginning of the detection time was extracted for analysis. A relatively shorter segment is preferred since it is easier to work with, providing for faster computations, but still containing :sufficient information on the time dependence of the signal. It is also stepped past the "hook" at the very beginning of the transient (see FIG. 17).

Knowing the frequencies of interest in the transient, in this case 374,586 Hz and 368,742 Hz, $a_0$ and m are chosen so that the width of the non-zero part of the wavelet function matches the period of the signal component looked for. This calculations yield $a_0=0.667403$ microseconds in the first case and $a_0=0.677981$ microseconds in the second case.

At this point, it is preferable to try to match the phases of the analyzing wavelet and the corresponding component of the transient. This was not as significant with the synthetic data previously described since both components in the synthetic signal were sine waves with phase of zero. It is relatively easy to start the Haar basis function at a place along the time axis that happened to be in phase with the synthetic components, so phase matching is not a concern. Thus, in analyzing real data, it is preferred that the additional step of phase matching be carried out. Phase matching can preferably be accomplished by shifting the time base in the equation that generates the particular wavelet basis function by various fractions of the width of the non-zero part of the basis function until the integral is maximized. For example, one may shift the wavelet function in time in steps of $a_0/10$ and calculate the wavelet coefficients (as defined in equation 4) for about 750 values of n. The wavelet basis function may be considered in phase with the transient component of interest when the sum of the $W_{m,n}$ is maximized This analysis is preferably done for each frequency component of interest because the phase differences for different frequency components are not necessarily equal.

With an appropriate choice for $b_0$, usually 1, the maximum value that n can have with the non-zero part of the wavelet function still within the time base is determined. Then the integer n is varied from 1 to its maximum value (in the program above, the step size is 8) which pushes the non-zero part of the wavelet function across the time base (e.g., see FIG. 16). The wavelet coefficients developed (as in equation 4) are returned in a vector from the computer program.

Figure 19:
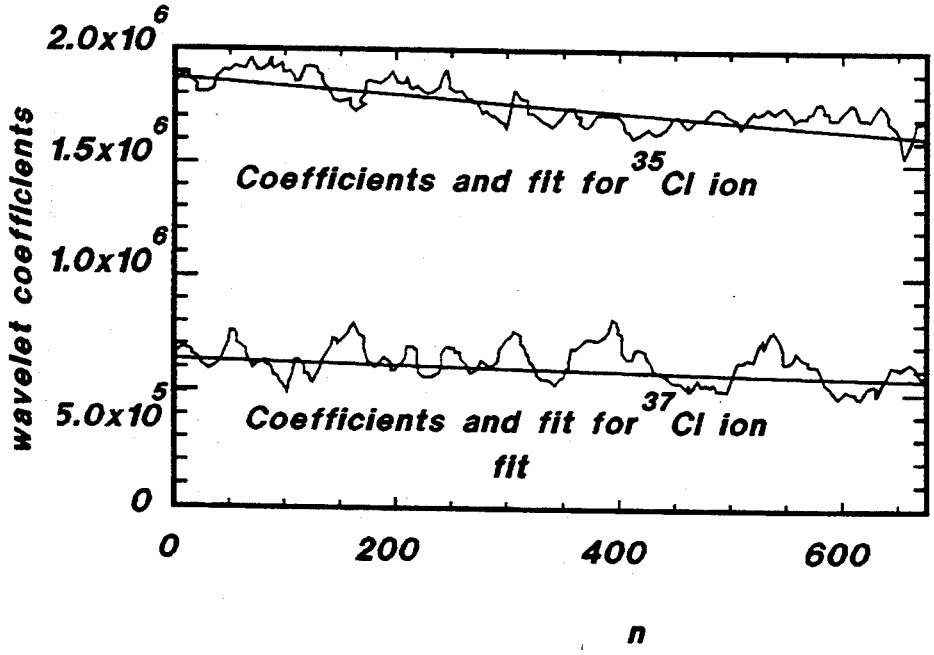
FIG. 19 is a graph showing the smoothed wavelet transform of the transient of FIG. 17, using wavelet functions of the type shown in FIGS. 14–16, and exponential decay lines fitted to the wavelet transforms.

The sets of wavelet coefficients are then smoothed (such as with a box car filter), since the frequency components beat against each other as with the synthetic data, except that with experimental data the frequencies are typically further apart, giving a higher beat frequency. The smoothed wavelets may be plotted as a function of n, and are fitted to an exponential decay. The smoothed wavelet coefficients and the fits are shown in FIG. 19. Knowing the relation between n and time, and realizing that the transient analyzed here actually began 750 microseconds after the detection period began, exponential fits can be created which are related to time with a time base that has its origin at the point at which detection began. The equations for the exponential fits as functions of time for the two components of interest are: $\log(WT)=14.459-1.8933\times10^{-5}t$ for the ion component with a m/z of 126 (the $^{35}Cl$ ion), and $\log(WT)=13.337-9.6953\times10^{-6}t$ for the ion component with a m/z of 128 (the $^{37}Cl$ ion). Note that the m/z 128 ion signal decays faster than the m/z 128 ion signal. This indicates that a conventional Fourier transform MS spectrum will show a less abundant m/z 126 ion relative to the m/z 128 ion as the time between excitation and detection increases.

Realizing that the excitation was turned off 600 microseconds before detection began, the fit equations can be used with $t=-600$ microseconds to determine relative abundances for the two ions at the time that excitation was turned off. This analysis predicts a relative abundance of the m/z 1213 ion to the m/z 126 ion of 32.4%, in much better agreement with the theoretical values than the relative abundance determined from conventional Fourier transform MS processing. This result is summarized in Table 2.

TABLE 2

| Estimates of Relative Ion Abundances | | |
|---|---|---|
| | Abundance of m/z 128 ion to m/z 126 ion | Error |
| Theoretical | 0.320 | — |
| Conventional Processing | 0.366 | +14.4% |
| Wavelet Analysis | 0.324 | +1.25% |

Of course, it is apparent that the present invention may be carried out with many appropriately selected mother wavelet functions in addition to the Haar function and a function based on the second derivative of the Gaussian.

It is understood that the invention is not confined to the particular embodiments set forth herein as illustrative, but embraces such modified forms thereof as come within the scope of the following claims.

What is claimed is:

1. A method of determining relative ion abundances of ions in a sample being measured in an ion cyclotron resonance mass spectrometer, comprising the steps of:

(a) ionizing a sample to be measured to provide at least two ion species, exciting ion cyclotron resonance in the ionized sample for a selected time, and then detecting the resonance in the excited ions and providing detected signal data corresponding thereto;

(b) determining the ion cyclotron resonance frequencies of at least two species in the sample being measured;

(c) selecting a mother wavelet function, and selecting a wavelet function for each ion cyclotron resonance frequency based on the mother wavelet function;

(d) performing wavelet transforms on the detected signal data using the wavelet functions selected for each frequency to provide wavelet transform data for each such frequency as a function of time;

(e) fitting an exponential decay function to the wavelet transforms determined for each frequency; and (f) determining an ion abundance value at a selected point in time on each of the fitted exponential decay functions for each frequency corresponding to an ion species.

2. The method of claim 1 including the step of comparing the values of the decay functions at the selected point in time to provide the relative ion abundances of each species: at such point in time.

3. The method of claim 1 wherein the selected point in time at which the values of the decay functions for the ion species are determined is the point in time at which the excitation of the ions ceases.

4. The method of claim 1 wherein the wavelet functions are selected so as to be in phase with the resonances of the excited ions as represented in the signal data.

5. The method of claim 1 wherein the mother wavelet function is the Haar function.

6. The method of claim 1 wherein the mother wavelet function is based on the second derivative of the Gaussian.

7. The method of claim 1 wherein the mother wavelet function has the form $\Psi(t)$, where t corresponds to time, and the selected wavelet functions have the form $$\Psi_{m,n}(t) = a_0^{-\frac{m}{2}}\Psi(a_0^{-m}t - nb_0),$$

and wherein in the step of selecting the wavelet functions for each species, the terms $a_0$ and m for each of the wavelet functions are selected to match the frequency of the frequency component determined for that ion species, and wherein n is varied to scan the wavelet function over the detected signal data as a function of time.

8. The method of claim 7 wherein the step of determining the wavelet transform of each ion species is carried out in accordance with the expression $$W_{m,n}(f) = a_0^{-\frac{m}{2}}\int_{-\infty}^{\infty}\Psi(a_0^{-m}t - nb_0)f(t)dt.$$

is where f(t) corresponds to the signal data as a function of time t.

9. The method of claim 7 wherein the wavelet transform is adjusted to be in phase with the resonances of the excited ions as represented in the signal dates by shifting $a_0^{-m}t\text{-}nb_0$ by a fraction of $a_0$.

10. The method of claim 9 wherein the fraction of $a_0$ is determined by shifting $a_0^{-m}t\text{-}nb_0$ by steps of $a_0/10$, calculating $W_{m,n}$ over n for each step, and selecting the shift amount to be that fraction of $a_0$ which maximizes $W_{m,n}$.

11. The method of claim 1 wherein the step of determining the ion cyclotron resonance frequencies of the at lest two ion species is carried out by Fourier transform processing of the detected signal data.

12. Mass spectrometry apparatus comprising:

(a) an ion trap including a plurality of electrode plates;

(b) means for detecting motion of ions in the trap and providing a signal indicative thereof;

(c) excitation means connected to the ion trap for selectively producing an electric field in the trap to provide excitation of the ions in the trap;

(d) means for analyzing data corresponding to the signal indicative of the detected motion of at least two species of ions in the trap utilizing a selected mother wavelet function and selected wavelet functions for each ion resonance frequency corresponding to a species based on the mother wavelet function, including means for performing wavelet transforms on the detected signal data using the wavelet functions selected for each frequency to provide wavelet transform data for each such frequency as a function of time, and for fitting an exponential decay function to the wavelet transforms determined for each frequency, and means for determining an ion abundance value at a selected point in time on each of the fitted exponential decay functions for each frequency corresponding to an ion species.

13. The apparatus of claim 12 including means for comparing the values of the decay functions at the selected point in time to provide the relative ion abundances of each species at such point in time.

14. The apparatus of claim 12 wherein the selected point in time at which the abundance values of the decay functions for the ion species are determined is the point in time at which the excitation of the ions ceases.

15. The apparatus of claim 12 wherein the wavelet functions are selected so as to be in phase with the resonances of the excited ions as represented in the signal data.

16. The apparatus of claim 12 wherein the mother wavelet function is the Haar function.

17. The apparatus of claim 12 wherein the mother wavelet function is based on the second derivative of the Gaussian.

18. The apparatus of claim 12 wherein the mother wavelet function has the form $\Psi(t)$ of where t corresponds to time, and the selected wavelet functions have the form $$\Psi_{m,n}(t) = a_0^{-\frac{m}{2}}\Psi(a_0^{-m}t - nb_0),$$

and wherein the terms $a_0$ and m for each of the wavelet functions are selected to match the frequency of the frequency component determined for that ion species, and wherein n is varied to scan the wavelet function over the detected signal data as a function of time.

19. The apparatus of claim 18 wherein the means for determining the wavelet transform of each ion species carries out the wavelet transform in accordance with the expression $$W_{m,n}(f) = a_0^{-\frac{m}{2}} \int_{-\infty}^{\infty} \Psi(a_0^{-m}t - nb_0)f(t)dt,$$

where f(t) corresponds to the signal data as a function of time t.

20. The apparatus of claim 18 wherein the wavelet transform is adjusted to be in phase with the resonances of the excited ions as represented in the signal data by shifting $a_0^{-m}t\text{-}nb_0$ by a fraction of $a_0$.

21. The apparatus of claim 20 wherein the fraction $a_0$ is determined by shifting $a_0^{-m}t\text{-}nb_0$ by steps of $a_0/10$, calculating $W_{m,n}$ over n for each step, and selecting the shift amount to be that fraction of $a_0$ which maximizes $W_{m,n}$.

22. The apparatus of claim 12 including means for determining the ion cyclotron resonance frequencies of the at least two ion species carried out by Fourier transform processing of the detected signal data.

* * * * *

UNITED STATES PATENT AND TRADEMARK OFFICE

CERTIFICATE OF CORRECTION

PATENT NO. : 5,436,447

DATED : July 25, 1995

INVENTOR(S) : Stanford L. Shew

It is certified that error appears in the above-indentified patent and that said Letters Patent is hereby corrected as shown below:

In column 1, line 25 of the patent, "(12≤m/q 5000)" should be --(12≤m/q≤5000)--

In column 4, line 6 of the patent, "Hzo" should be --Hz.--

In column 7, line 40 of the patent, "a m" should be --$a_0^m$, or,--

In column 8, line 44 of the patent, --Signal-- should be inserted before "generation"

In column 9, line 31 of the patent, "x = time * a0 (-m) - n * b0" should be --x = time * a0 ^ (-m) - n * b0--

In column 9, line 33 of the patent, "ON-ERROR, 2" should be --ON_ERROR, 2--

In column 9, line 39 of the patent, "x = time * a0 (-m) - n * b0" should be --x = time * a0 ^ (-m) - n * b0--

UNITED STATES PATENT AND TRADEMARK OFFICE

CERTIFICATE OF CORRECTION

PATENT NO. : 5,436,447

DATED : July 25, 1995

INVENTOR(S) : Stanford L. Shew

It is certified that error appears in the above-indentified patent and that said Letters Patent is hereby corrected as shown below:

In column 10, line 33 of the patent,
"phi (x * a0 (-m) - n * b0" should be
--phi (x * a0 ^ (-m) - n * b0)--

In column 10, line 38 of the patent,
"t = a0 m * n * b0" should be --t = a0 ^ m * n * b0--

In column 10, line 42 of the patent,
"nhi = FIX(len * a0 (-m)/b0)" should be
--nhi = FIX(len * a0 ^ (-m)/b0)--

In column 14, line 6 of the patent,
"y = (1 - t 2)*exp(-t 2/2)" should be
--y = (1 - t^2)*exp(-t^2/2)--

In column 14, line 8 of the patent,
"t = s * a_0 (-M) - n * b_0" should be
--t = s * a_0 ^ (-M) - n * b_0--

In column 14, line 15 of the patent,
"sta = s * a_0 (-m) - n * b_0" should be
--sta = s * a_0 ^ (-m) - n * b 0--

UNITED STATES PATENT AND TRADEMARK OFFICE

CERTIFICATE OF CORRECTION

PATENT NO. : 5,436,447

DATED : July 25, 1995

INVENTOR(S) : Stanford L. Shew

It is certified that error appears in the above-indentified patent and that said Letters Patent is hereby corrected as shown below:

In column 15, line 8 of the patent, "phi (x * a0 (-m) - n * b0)" should be --phi (x * a0^(-m) - n * b0)--

In column 15, line 14 of the patent, "nhi = FIX (time (len-1) * a0 (-m)/bo)" should be --nhi = FIX (time (len-1) * a0^(-m)/bo)--

In column 16, line 42 of the patent, "m/z 1213" should be --m/z 128--

In column 17, line 27 of the patent, "species:" should be --species--

Signed and Sealed this

Thirteenth Day of August, 1996

Bruce Lehman

*Attest:*

BRUCE LEHMAN

*Attesting Officer*

*Commissioner of Patents and Trademarks*